United States Patent [19]

Hanni et al.

[11] 4,014,204

[45] Mar. 29, 1977

[54] MACHINE FOR PROCESSING METAL IN SHEET OR PLATE FORM

[75] Inventors: Eduard Alexander Hanni, Zofingen; Vaclav Fraubisik Zbornik, Oftringen, both of Switzerland

[73] Assignee: Haemmerle, A.G., Zofingen, Switzerland

[22] Filed: May 27, 1975

[21] Appl. No.: 580,741

[30] Foreign Application Priority Data

May 27, 1974 Austria ..... 4330/74

[52] U.S. Cl. ..... 72/465; 72/382; 72/413; 267/130

[51] Int. Cl.[2] ..... B21D 5/01

[58] Field of Search ..... 72/57, 382, 396, 465, 72/473, 413, 415, DIG. 14; 267/119, 130

[56] References Cited

UNITED STATES PATENTS

| | | | |
|---|---|---|---|
| 1,437,953 | 12/1922 | Baily | 72/415 |
| 3,702,558 | 11/1972 | Swenson et al. | 72/465 |

*Primary Examiner*—Lowell A. Larson

[57] ABSTRACT

The invention relates to a machine for processing metal in sheet or plate form, and especially for bending metal sheets, which includes a machine frame, a table base and a ram vertically displaceable in relation to the table base. An upper tool is mounted on the ram and a lower tool cooperating therewith is disposed on the table base over the U section filled with oil with the sheet therebetween, these two tools bending the metal sheet. One of the tools is supported by a compliant support member for the tool. The compliant support member supporting the tool comprises a plurality of individual elements which are disposed tightly besides each other in the oil in the U section and are independently displaceable in a vertical direction so that, in operation, only those elements are displaced towards the supporting means on which the work sheet rests.

1 Claim, 4 Drawing Figures

MACHINE FOR PROCESSING METAL IN SHEET OR PLATE FORM

CROSS REFERENCE TO RELATED APPLICATIONS

Austrian patent application No. 4330/74, filed May 27, 1974, under which priority is claimed under 35 U.S.C. 119.

BACKGROUND OF THE INVENTION

1. Field of the Invention

The present invention relates to a machine for processing metal in sheet or plate form, especially for bending metal sheets, with a lower bending tool and an upper bending tool, these two tools cooperating to perform the bending of the metal sheet, and with a work table, whereby one of the bending tools is supported by an elastic supporting member or by a oil cushion, to provide a direct or indirect elastic supporting.

2. Description of the Prior Art

A frequent occurrence in high-pressure press brakes is that while a work-piece is being dealt with, the push-rod bends up and the work-table bends down, with the result that there remains between the upper tool mounted on the push-rod and the lower tool monted on the work table a gap which is larger towards the centre than at both ends; machining accuracy is therefore impaired. It is therefore necessary to avoid such a deformation of the upper and/or lower tool, or to compensate for such a deformation. For the solution of this problem, it has been proposed to use Hanni et al, U.S. Pat. Nos. 3,682,465 and 3,829,074 a work-table for machines for processing metal in sheet or plate form, more particularly press brakes, which compensate automatically for a deformation of this kind or ensures that no such deformation can occur. This is achieved by providing the work-table with a work-table panel, a support element therefor extending the length of the work-table panel and mounted in a member for vertical displacement therein and defining therewith a chamber for receiving oil on which the support element will rest. According to an especially favourable form of execution of such a work-table, there is provided an elastic diaphragm which covers the oil-receiving chamber and on which the support element will rest. In this way, all sealing problems are overcome and such a machine will be less expensive in construction and more reliable in use.

Such a work-table has proved very reliable and it has been shown that very precise work can be performed with a machine equipped with such a work-table. However, it had to be recognized as disadvantageous that the machining accuracy is impaired as soon as the work-piece is much shorter than the work-table. If only a part of the work table is subjected to high pressure during the bending step, the work-piece may be pressed too much at its ends, resulting in an unprecise machining there.

OBJECTS OF THE INVENTION

It is the primary object of the present invention to provide a machine for processing metal in sheet or plate form which is able to work with a higher degree of precision than known machines of the kind described above.

It is another object of the present invention to provide a machine of the kind described above with a work table that also solves this problem. With a machine according to the present invention, all kinds and sorts of work-pieces in every size can be processed with the same accuracy.

SUMMARY OF THE INVENTION

According to the present invention, there is provided a machine for processing metal in sheet or plate form, especially for bending metal sheets, with a lower bending tool, disposed on a work table panel, and an upper bending tool, disposed on a ram or a push-rod of the machine, these two tool cooperating to perform the bending of the metal sheet, whereby one of the bending tools is supported by an elastic supporting member or by an oil cushion to provide a direct or indirect elastic supporting of the tool. This machine is characterized by the fact that either the elastically supported tool itself or the supporting member for this tool consists of a plurality of individual elements which are disposed besides each other and are independently movable in vertical direction so that, in operation, only those elements are displaced towards the elastic supporting member on which the work-piece rests, directly or indirectly.

BRIEF DESCRIPTION OF THE DRAWING

In the following, there will be described, by way of example only, two embodiments of a press brake according to the invention, with reference to the accompanying drawings, in which.

DESCRIPTION OF THE PREFERRED EMBODIMENTS

Figure 1:
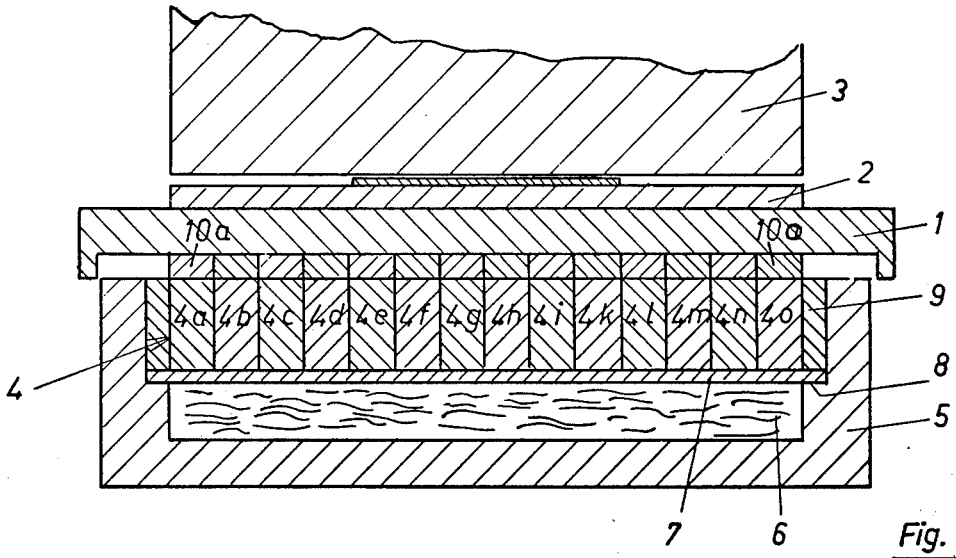
FIG. 1 is a schematic longitudinal section through a work table of a press brake, at the beginning of the bending step.
Figure 2:
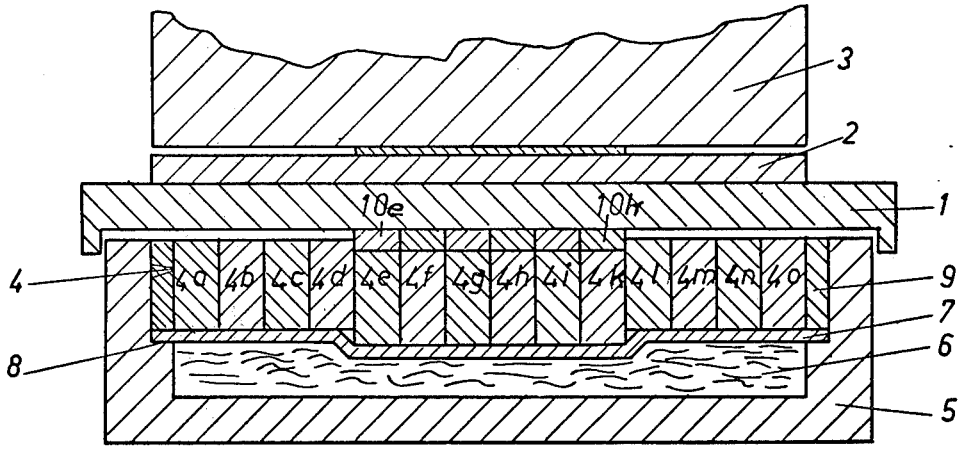
FIG. 2 is a corresponding section as in FIG. 1, but during the bending step.

As can be seen from FIGS. 1 and 2, a machine according to the invention comprises a work-table 5 with a work-table panel 1. This work-table panel 1 supports a lower bending tool 2 which cooperates with an upper bending tool 3 arranged in the ram (not shown) of the machine. This being a well known arrangement removes the need for further explanation or illustration in the drawings.

The lower tool 2 on the work-table panel 1 is supported by a supporting member generally designated with 4. The supporting member 4 comprises a plurality of supporting elements 4 *a* . . . 4 *o*, arranged tightly besides each other in a row to form the supporting member, the length of which corresponding approximately to the length of the work-table panel 1. The individual supporting elements 4 *a* . . . 4 *o* each have a cross section substantially in the form of an inverted T, as can be seen from FIG. 3.

Figure 3:
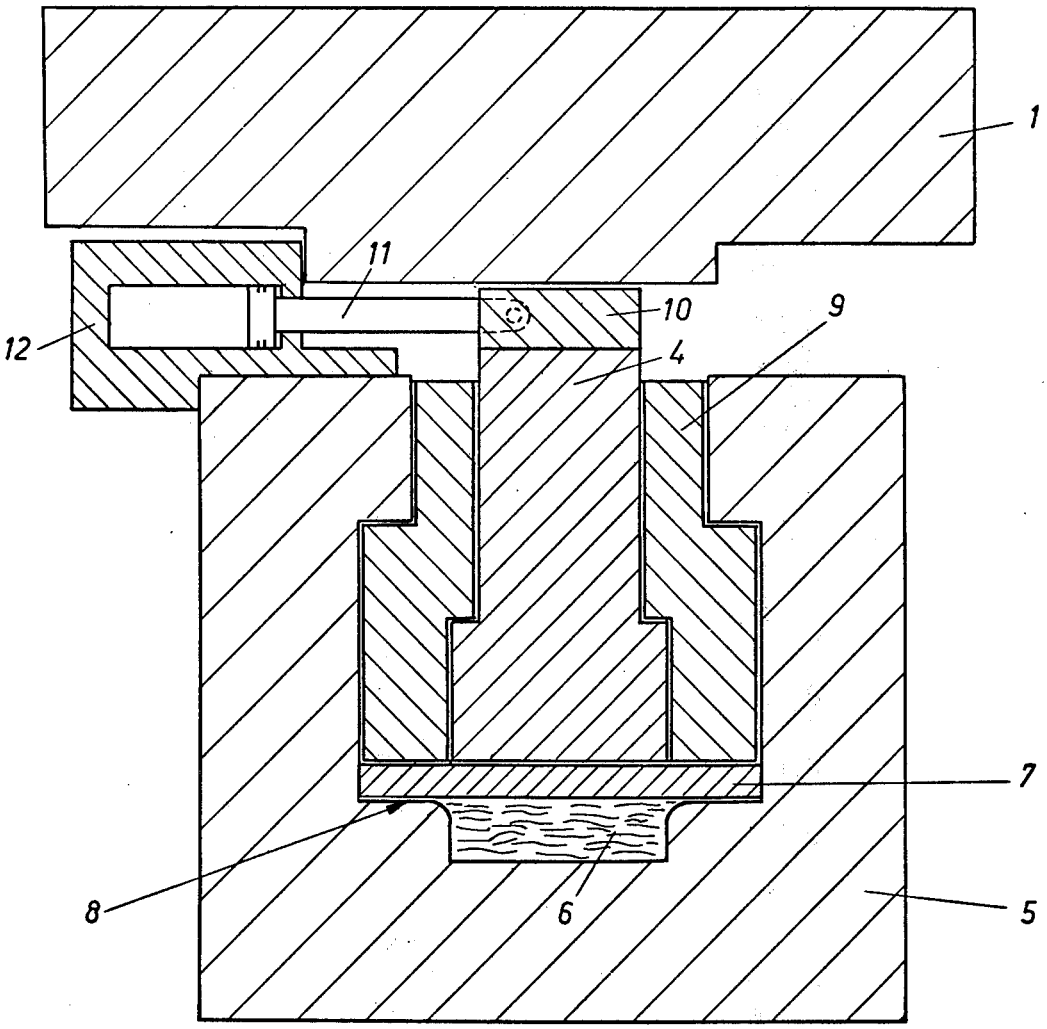
FIG. 3 is a section along the lines A—A in FIG. 2.

As can further be seen from FIG. 3, the work-table 5 has a cross section substantially in the form of an U, whereby the individual supporting elements 4 *a* . . . 4 *o* are received in the interior of the U. For this purpose, there is provided a guiding element 9 which is shaped to allow the supporting elements 4 *a* . . . 4 *o* individually to be displaced in vertical direction.

Below the support elements 4 *a* . . . 4 *o* there is provided an oil-filled chamber 6 covered by an elastic diaphragm 7 on which the supporting elements 4 *a* . . . 4 *o* rest with their lower surface. Along its edges the diaphragm 7 is supported by protrusions 8 and fixed in its position by the lower surface of the guiding element 9, which rests against the said edge area of the diaphragm 7. In this way, there is achieved a reliable sealing of the oil-filled chamber 6. The supporting elements 4 *a* . . . 4 *o*, which are independently displaceable in vertical direction, rest with their lower surface against the upper surface of the diaphragm 7 and transfer, in this way, the forces involved during the bending of a work-piece via the diaphragm 7 to the oil cushion 6.

Each supporting element 4 *a* . . . 4 *o* comprises a cap 10 *a* . . . 10 *o*, inserted between the upper surface of the supporting element and the lower surface of the work-table panel 1. As can be seen from FIG. 3, each of the caps is connected to an associated piston-cylinder-unit 12 by means of a connecting rod 11. By an actuation of the piston of the piston-cylinder-unit 12, each of the caps 10 *a* . . . 10 *o* is displaceable in horizontal direction. In FIG. 3 there is shown the working position of the caps 10 where they connect the work-table panel 1 to the supporting member 4. By actuating the piston of the piston-cylinder-unit 12 to move in a leftwards direction, the cap 10 is removed from the position between panel 1 and supporting member 4 and displaced to the left side in a rest position, where the connection between panel 1 and supporting member 4 is interrupted. Of course it is possible to replace the piston-cylinder-units 12 by e.g. electromagnets or handles (not shown) to displace them manually from the working position to the left side rest position, and back to the working position.

Referring now to FIG. 2, there can be seen a diagrammatic cross-sectional view of a press brake during the bending step. As can be seen from the drawing, a work piece is to be bent that requires only a part of the total length capacity of the press brake. If one would use a solid, integral supporting member as it is known in the art, there would be a danger of over-compensation with unprecise shaping of the work-piece at its edges. This serious drawback is avoided with the press brake according to the invention because it is possible to precisely adapt the supporting member 4 to the size of the work-piece to be bent. Such adaption is achieved in removing all of the caps not actually needed for the bending step, i.e. the caps 10 *a*, 10 *b*, 10 *c* and 10 *d* as well as the caps 10 *l*, 10 *m*, 10 *n* and 10 *o* are displaced to their rest position, where they are ineffective. Only the caps immediately below the work-piece to be bent are in their working position, i.e. the caps 10 *e*, 10 *f*, 10 *g*, 10 *h*, 10 *i* and 10 *k* are effective. In this way, only those supporting elements 4 have an effect on the bending of the work-piece which are immediately below the work-piece, i.e. the supporting elements 4 *e*, 4 *f*, 4 *g*, 4 *h*, 4 *i* and 4 *k*, while the remaining supporting elements are ineffective, i.e. the supporting elements 4 *a* . . . 4 *d* and 4 *l* . . . 4 *o*. The supporting elements 4 *e* . . . 4 *k* effectively support the work-piece and enable the machine to perform a shaping of the work piece with a very high precision.

If a work-piece with a different size has to be processed, it is necessary to adapt the press brake to the new work-piece size. This is achieved by displacement of the caps 10 from their working position to their rest position or vice versa. This always ensures optimal working conditions for the press brake. The quickest way for adapting the press to a new work-piece dimension is, of course, the provision of pneumatically or electrically displaceable caps, but even a manual displacement does not take very much time nor is it very difficult.

It should be noted that one may invert the whole construction of the described press brake to obtain exactly the same effect. This is to say, you could support the lower tool on a rigid base, but the upper tool against an elastic supporting cushion via supporting elements provided with corresponding caps. In addition, it is possible to replace the oil cushion by an elastomeric cushion of any suitable material or by a plurality of springs disposed within the chamber 6. In the latter case, no diaphragm 7 would be needed.

Figure 4:
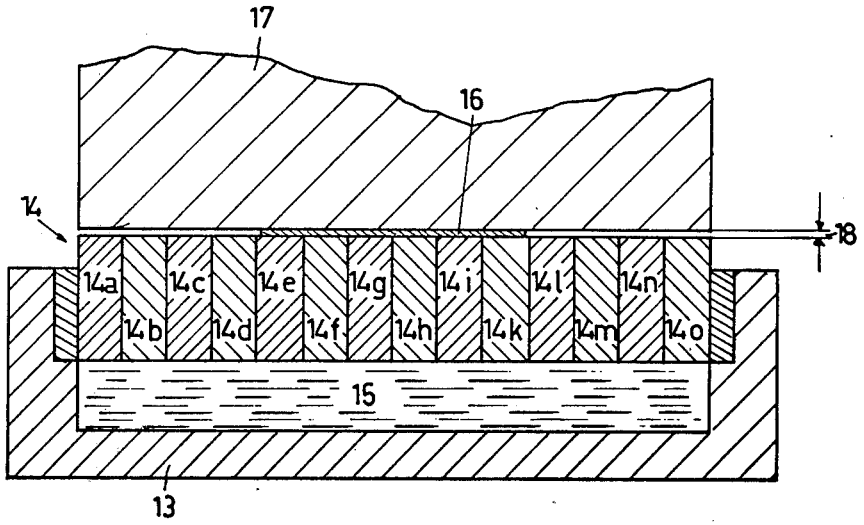
FIG. 4 is a schematic longitudinal section through the work-table of another embodiment of a press brake.

A further embodiment of the invention, much simpler in construction, is shown in FIG. 4. There is provided a work-table 13, which is adapted to receive a lower tool 14. The lower tool 14 comprises a plurality of individually displacable tool elements 14 *a* . . . 14 *o*, which are disposed tightly besides each other. Below the elements 14 *a* . . . 14 *o* there is provided a chamber 15 which is adapted to receive an elastomeric cushion of any suitable material. The lower surfaces of the elements 14 *a* . . . 14 *o* rest against the upper surface of the elastomeric cushion in the chamber 15.

As can be seen from FIG. 4, a work-piece 16 rests against the lower tool 14, consisting of the elements 14 *a* . . . 14 *o*. The upper tool 17 is of integral construction as known in the art. As soon as pressure is applied to the work-piece, only those elements 14 on which the work-piece rests are displaced, i.e. the elements 14 *e* . . . 14 *k*. Only after an additional stroke 18 of the upper tool has been performed —the said stroke 18 corresponding to the thickness of the work-piece 16— also the remaining elements 14 *a* . . . 14 *d* and 14 *l* . . . 14 *o* are displaced by the downward movement of the upper tool 17. In this way there can be performed a precise machining of the work-piece 16 without any overstress at its edges, as it is supported only along its length.

It should be noted that, in turn, the upper tool 17 may consist of a plurality of tool elements which are elastically supported by a oil cushion or a elastomeric cushion. In this case, the lower tool would be in conventional, integral form and rigidly supported. The embodiment according to FIG. 4 has the advantage that the caps on the supporting elements are not needed, resulting in a simpler and less expensive construction. However, the machining accuracy is not impaired.

We claim:

1. A machine for bending metal in sheet or plate form comprising:

a machine frame;

a table base on said frame having a cross section in the form of a U defining a confined oil-filled supporting space;

a ram vertically displaceable in relation to said table base;

an upper tool mounted on said ram;

a lower tool disposed on said table base;

said upper and lower tools cooperating for bending said metal sheet therebetween;

flexible supporting means for one of said tools comprising an elastic diaphragm and a plurality of individual elements thereover, side by side, in the U of said work table and in the confined oil-filled supporting space of said U section to provide an elastic and compliable supporting of the tool;

said plurality of individual elements being disposed tightly beside each other and each being independently displaceable in a vertical direction so that, in bending operation, only certain elements are displaced;

each of said individual elements comprising a lower part resting on said elastic diaphragm and an upper part resting on said lower part, said upper parts being adapted to support the tool and being independently displaceable in a horizontal direction from a working position where it rests on said lower part to a rest position where it is out of the path of movement of said lower part; and, a plurality of piston-cylinder-units connected one to each of said upper parts of said individual elements by a connecting rod and being so connected to the piston so that an actuation of the piston of the piston-cylinder-unit removes said upper part from its position between said tool and said lower part.

* * * * *